US009132054B2

(12) United States Patent
Rojdev

(10) Patent No.: US 9,132,054 B2
(45) Date of Patent: Sep. 15, 2015

(54) UNIVERSAL CASKET ORNAMENT ATTACHMENT MECHANISM AND METHOD

(71) Applicant: Batesville Services, Inc., Batesville, IN (US)

(72) Inventor: Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 13/949,985

(22) Filed: Jul. 24, 2013

(65) Prior Publication Data

US 2015/0026938 A1 Jan. 29, 2015

(51) Int. Cl.

| | |
|---|---|
| ***A61G 17/04*** | (2006.01) |
| ***A61G 17/00*** | (2006.01) |
| ***A47G 1/17*** | (2006.01) |

(52) U.S. Cl.

CPC *A61G 17/04* (2013.01); *A47G 1/17* (2013.01); *A61G 17/00* (2013.01)

(58) Field of Classification Search

CPC ..... A61G 17/00; A61G 17/02; A61G 17/04; A61G 2017/00; A61G 2017/04; G09F 3/12; G09F 7/04; A47G 1/17

USPC ..... 27/2, 10, 14, 19; 40/600, 621, 661.06, 40/668

See application file for complete search history.

(56) References Cited

U.S. PATENT DOCUMENTS

| | | | | |
|---|---|---|---|---|
| 2,659,169 | A * | 11/1953 | Brennan | 40/1.5 |
| RE25,525 | E * | 2/1964 | Harrell | 428/3 |
| 6,557,222 | B2 | 5/2003 | Groemminger et al. | |
| 6,591,466 | B1 | 7/2003 | Acton et al. | |
| 6,691,385 | B2 | 2/2004 | Bell et al. | |
| 6,883,212 | B2 | 4/2005 | Groemminger et al. | |
| 6,928,706 | B2 | 8/2005 | Acton et al. | |
| 7,210,204 | B2 | 5/2007 | Groemminger et al. | |
| 7,340,810 | B2 | 3/2008 | Acton et al. | |
| 7,591,052 | B2 | 9/2009 | Bovard et al. | |
| 8,196,275 | B2 * | 6/2012 | Wessel | 27/10 |
| 8,220,119 | B2 * | 7/2012 | Burlage et al. | 27/14 |
| 8,387,219 | B2 * | 3/2013 | Rojdev | 27/10 |
| 8,429,840 | B2 * | 4/2013 | Mottola | 40/590 |
| 8,555,471 | B2 * | 10/2013 | Rojdev | 27/14 |
| 8,567,023 | B2 * | 10/2013 | Burlage et al. | 27/14 |
| 8,667,653 | B2 * | 3/2014 | Drew et al. | 27/19 |

(Continued)

OTHER PUBLICATIONS

U.S. Appl. No. 61/675,628, filed Jul. 25, 2012.

(Continued)

*Primary Examiner* — William Miller

(74) *Attorney, Agent, or Firm* — Wood, Herron & Evans, LLP

(57) ABSTRACT

A casket comprises a casket shell including at least one keyhole groove in an exterior surface thereof, a casket lid closeable on the shell, the lid including a magnetic cap panel mounted therein, a universal ornament base having a front side and a rear side, the rear side including at least one magnet mounted thereon and at least one fastener secured thereto, the fastener having a head thereon, and an ornament insert secured to the front side of the ornament base. The ornament base and ornament insert can be removably secured to the shell by inserting the head of the fastener in the keyhole groove of the shell and seating the head of the fastener in the keyhole groove, or the ornament base and ornament insert can be removably secured to the lid by positioning the magnet on the magnetic cap panel, as desired.

25 Claims, 9 Drawing Sheets

(56) References Cited

U.S. PATENT DOCUMENTS

| | | | | |
|---|---|---|---|---|
| 8,756,774 | B2 * | 6/2014 | Rojdev | 27/14 |
| 2010/0077579 | A1 | 4/2010 | Parker | |
| 2010/0293826 | A1 * | 11/2010 | Mottola | 40/590 |
| 2010/0299895 | A1 | 12/2010 | Burlage et al. | |
| 2011/0078882 | A1 * | 4/2011 | Wessel | 27/1 |
| 2012/0266423 | A1 | 10/2012 | Rojdev | |
| 2013/0074299 | A1 | 3/2013 | Rojdev | |
| 2014/0041170 | A1 * | 2/2014 | Bovard et al. | 27/14 |

OTHER PUBLICATIONS

U.S. Appl. No. 13/948,605, filed Jul. 23, 2013.

* cited by examiner

UNIVERSAL CASKET ORNAMENT ATTACHMENT MECHANISM AND METHOD

RELATED APPLICATIONS

N/A

FIELD OF THE INVENTION

This invention relates generally to caskets, and more particularly to mechanisms for attaching ornaments to caskets, urns, and other funerary articles.

BACKGROUND OF THE INVENTION

It is known to attach decorative ornaments to caskets to "personalize" the casket to the deceased. Examples of mechanisms for attaching generally three-dimensional "figurine" style ornaments to the exterior of a casket, for example to the corners of the casket shell, are shown in, for example, the assignee's U.S. Pat. Nos. 6,591,466, 6,928,706, 7,340,810 and 7,591,052, and US Patent Application Publication No. 2010/0077579, all hereby incorporated by reference herein as if fully set forth in their entireties. The casket corner ornaments of the '466, '706, and '810 patents, and the '579 publication, utilize fasteners with heads, for example shoulder screws, mounted on the rear side of the ornament, the heads of which are secured in keyhole slots, for example L-shaped keyhole slots, in the casket shell corners. These ornaments are commercially available from the assignee as its LIFESYMBOLS® line of casket shell corner ornaments.

Examples of mechanisms for attaching ornaments to the interior of a casket, for example to the cap panel mounted in the underneath side of the head end casket cap, are shown in, for example, the assignee's US Patent Application Publication No. 2010/0299895, hereby incorporated by reference herein as if fully set forth in its entirety. One embodiment of the ornaments for attachment to the cap panel disclosed in the '895 publication utilizes one or more magnets mounted on the rear side of a generally two-dimensional "medallion" style ornament (a relatively thin, flat, circular medal, for example) for magnetically attaching the medallion to a magnetic cap panel. These ornaments are commercially available from the assignee as its LIFESTORIES® line of casket cap panel medallions.

It was desirable to be able to utilize the medallion ornaments with magnets thereon with the casket shell L-shaped keyhole slots so that the medallions could also be mounted on the casket shell corners. To that end, a casket ornament attachment mechanism of the type shown in the assignee's US Patent Application Publication No. 2012/0266423, hereby incorporated by reference herein as if fully set forth in its entirety, was devised. The '423 publication discloses a medallion casket ornament having at least one magnet mounted on the rear side thereof, and a magnetic adapter plate having at least one fastener with a head thereon mounted on the rear side thereof. The adapter plate is removably secured to the casket shell by inserting the head of the fastener in the keyhole groove of the casket shell and seating the head of the fastener in the keyhole groove. The casket ornament is then removably magnetically secured to the shell by positioning the magnet of the ornament on the adapter plate.

It was also desirable to be able to use the casket corner ornaments having fasteners with heads on magnetic cap panels. To that end, the assignee devised a conversion kit for supply to funeral directors for converting a casket shell corner compatible ornament into a magnetic cap panel compatible ornament. That conversion kit comprised of two magnets and two Phillips screws. Each magnet has a bore for accepting its screw. To convert the casket corner ornament, the two shoulder screws (that cooperate with the L-shaped keyhole slots in the casket shell corner) are removed, and each is replaced with one of the magnets and one of the Phillips screws. The casket corner ornament can then be attached to a magnetic cap panel for display.

While the above-described casket ornament attachment mechanism of the '423 publication and conversion kit both function as designed, nevertheless they are not without drawbacks. For example, the funeral director or funeral home owner must keep on hand several adapter plates and conversion kits, at extra cost. Each conversion kit, while separately packaged, nevertheless includes four fairly small parts which are readily lost, misplaced, etc. And, the act of converting casket corner compatible ornaments into magnetic cap panel compatible ornaments with conversion kits is time consuming.

Accordingly, it is further desirable to devise a single or universal casket ornament attachment mechanism which would permit both the generally three-dimensional figurine type casket shell corner ornaments as well as the generally two-dimensional medallion type casket lid cap panel ornaments to be readily secured to either the casket shell corner or to the casket cap magnetic cap panel. This would permit a funeral director to be able to quickly and easily attach either type of ornament to either casket location without having to change out the fastener hardware, keep on hand and keep track of loose magnets, lose screws, adapter plates, and the like.

SUMMARY OF THE INVENTION

In one aspect, a casket comprises a casket shell including at least one keyhole groove in an exterior surface thereof, a casket lid closeable on the shell, the lid including a magnetic cap panel mounted therein, a universal ornament base having a front side and a rear side, the rear side including at least one magnet mounted thereon and at least one fastener secured thereto, the fastener having a head thereon, and an ornament insert secured to the front side of the ornament base. The ornament base and ornament insert can be removably secured to the shell by inserting the head of the fastener in the keyhole groove of the shell and seating the head of the fastener in the keyhole groove, or to the lid by positioning the magnet on the magnetic cap panel, as desired.

The ornament insert can be either a generally three-dimensional figurine type ornament or a generally two-dimensional medallion type ornament. The ornament base can be fabricated of plastic, for example. The magnet can be positioned on an axis of symmetry of the ornament base and the fastener can be positioned offset from the axis of symmetry of the ornament base. The at least one magnet preferably comprises a single magnet positioned near a perimeter of the ornament base and on an axis of symmetry of the ornament base, and the at least one fastener preferably comprises a pair of vertically spaced fasteners positioned well within the perimeter of the ornament base and offset from the axis of symmetry of the ornament base.

In another aspect, a universal ornament base for removably securing a casket ornament insert to a keyhole groove in an exterior of a casket shell, or to a magnetic cap panel mounted in a casket lid, as desired, is provided. The universal ornament base comprises an ornament base body having a front side and a rear side, the rear side of the ornament base body including at least one magnet mounted thereon and at least one fastener secured thereto, the fastener having a head thereon, and the front side of the ornament base body configured to have the casket ornament insert secured thereto. The ornament base and the ornament insert can be removably secured to the shell by inserting the head of the fastener in the keyhole groove of the shell and seating the head of the fastener in the keyhole groove, or to the lid by positioning the magnet on the magnetic cap panel, as desired.

In another aspect, a method of personalizing a casket according to a family member's wishes, the casket having a keyhole groove in an exterior of a shell of the casket and a magnetic cap panel mounted in a lid of the casket, is provided. The method comprises receiving the casket, receiving an ornament insert, receiving a universal ornament base configured to have the ornament insert secured on one side thereof, and configured to have a fastener with a head thereon and a magnet secured on the other side thereof, receiving the fastener, receiving the magnet, querying the family member as to whether the ornament insert and ornament base are to be mounted to the casket shell or to the casket lid, securing the ornament insert to the ornament base, and in response to the answer received from the family member to the query, removably securing the ornament insert and ornament base either to the casket shell by inserting the head of the fastener in the keyhole groove of the shell and seating the head of the fastener in the keyhole groove, or to the casket lid by positioning the magnet on the magnetic cap panel.

The method can further comprise the step of, prior to the step of removably securing the ornament insert and ornament base either to the casket shell or to the casket lid, securing either the fastener or the magnet to the ornament base in response to the answer received from the family member to the query. The steps of receiving the ornament base, receiving the fastener, and receiving the magnet can comprise receiving the ornament base with the fastener and the magnet preinstalled thereto. The universal ornament base can be a universal medallion base and the universal ornament insert can be medallion insert. The medallion insert can be a metallic die-struck medallion insert, a button medallion insert, or a domed medallion insert.

In another aspect, a method of personalizing a casket according to a family member's wishes is provided. The method comprises receiving a plurality of ornament inserts, receiving a universal ornament base configured to have a selected ornament insert of the plurality of ornament inserts secured on one side thereof, and configured to have a fastener with a head thereon and a magnet secured on the other side thereof, receiving the fastener, receiving the magnet, presenting the plurality of ornament inserts to the family member, allowing the family member to select an ornament insert from the plurality of ornament inserts, querying the family member as to whether the selected ornament insert and ornament base are to be mounted to a casket shell or to a casket lid, securing the selected ornament insert to the ornament base, and in response to the answer received from the family member to the query, removably securing the selected ornament insert and ornament base either to the casket shell by inserting the head of the fastener in a keyhole groove in an exterior of the casket shell and seating the head of the fastener in the keyhole groove, or to the casket lid by positioning the magnet on a magnetic cap panel mounted in the casket lid.

The universal ornament base can be a universal medallion blank and the ornament insert can either be a medallion insert or a figurine insert.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
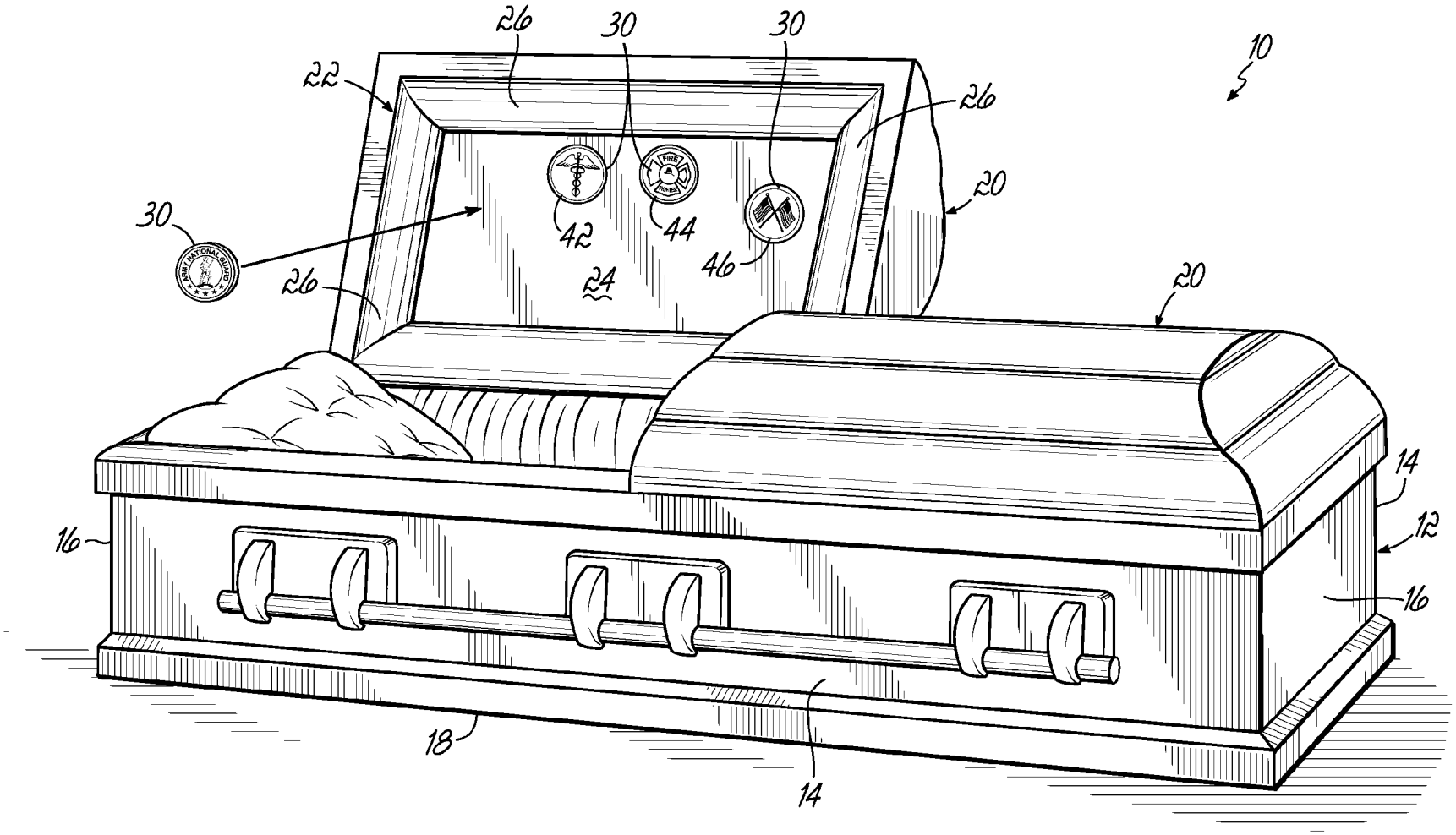
FIG. 1 is a perspective view of a casket according to the principles of the present invention.

Referring to FIG. 1, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. Cap 20 has an ornamental dish assembly 22 mounted to an underside of the cap 20. The dish assembly 22 includes a cap panel 24 and may include ornamental puffing members 26 mounted around a periphery of the dish assembly 22. One or more ornaments, for example medallions 30, are mounted to the cap panel 24 of the dish assembly 22. The medallion 30 has text and/or graphics representing a life aspect of the deceased, for example, Father, Brother, Husband, Lawyer, Christian, Hunter, Fisherman, etc.

Figure 2:
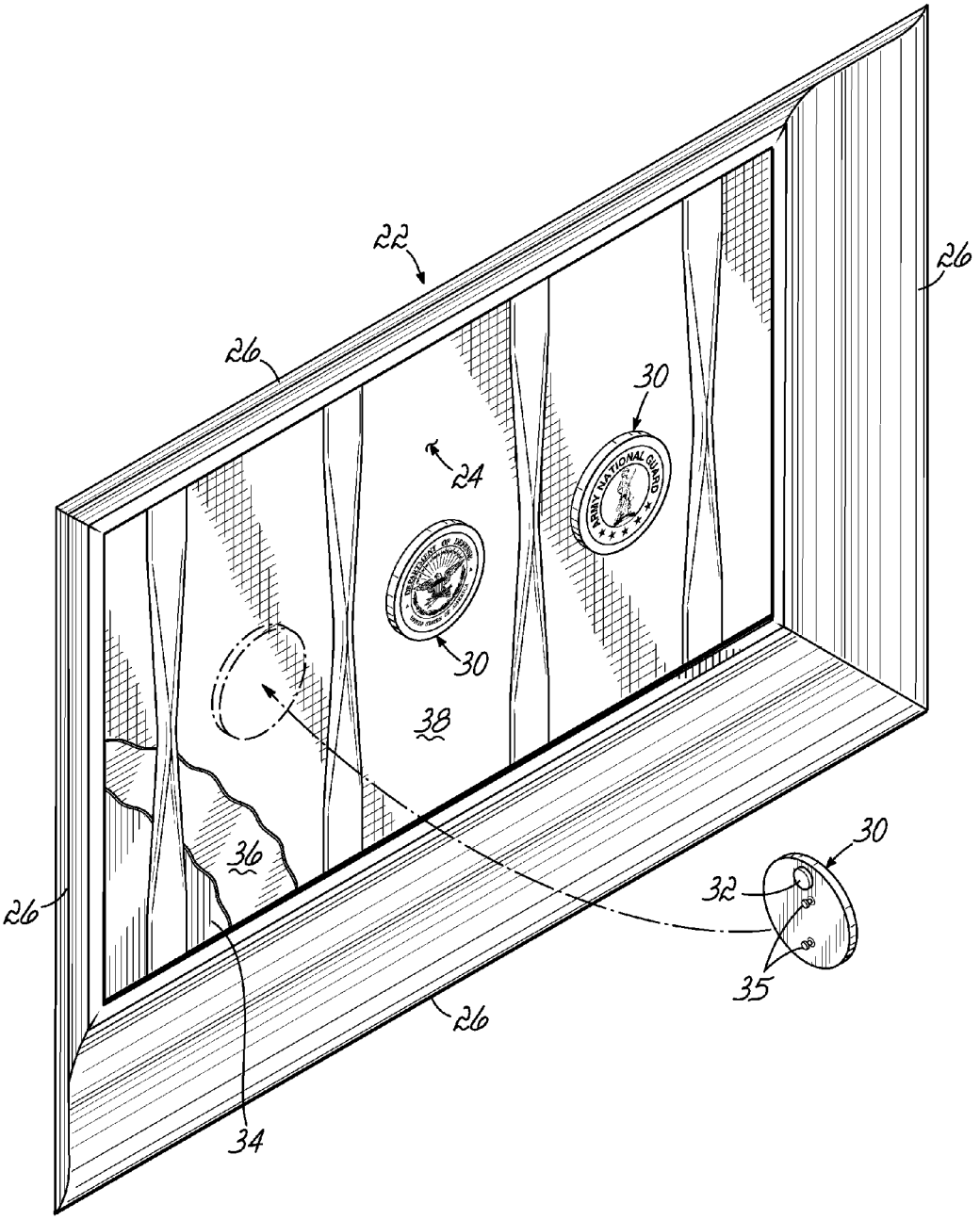
FIG. 2 is a perspective view of the casket cap dish assembly and medallions.

Referring to FIG. 2, the dish assembly 22 is constructed in such a way as to permit medallions 30 to be placed anywhere on the cap panel 24. More particularly, each medallion 30 has a magnet 32 secured on a rear side thereof, for example permanently secured on the rear side thereof or in recesses on/in the rear side thereof with screws, adhesives or the like. Acceptable magnets 32 are neodymium magnets, for example the model ND007509N available from Master Magnetics, Inc., Castle Rock, Colo., www.magnetsource.com. The cap panel 24 is fabricated from a sheet of cardboard or chipboard 34 over which is placed a sheet of magnetic material 36, for example steel. The sheet of magnetic material 36 is then covered with a sheet of decorative material 38. Since the entire surface area of the cap panel 24 is magnetic material, medallions 30 can be placed anywhere within the surface area of the cap panel 24. This permits more freedom in placing and arranging medallions as desired by the funeral director and family, friends, and loved ones of the deceased. Each medallion 30 further includes at least one, and preferably two, shoulder screws 35 attached to a rear face of the medallion 30 for purposes described below.

Figure 3A:
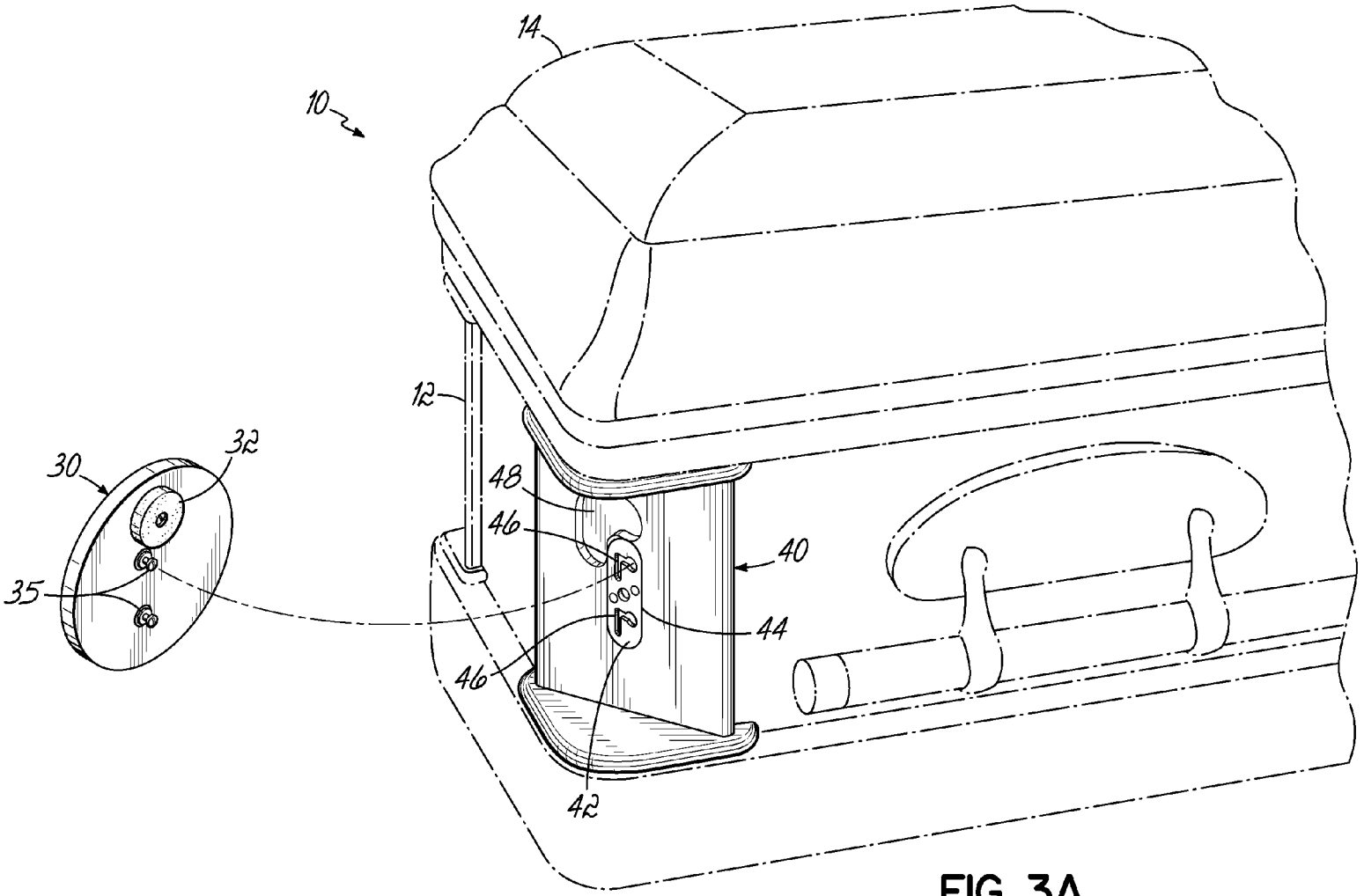
FIG. 3A is a disassembled partial perspective view of the casket shell corner, universal medallion base, and die-struck medallion insert.
Figure 3B:
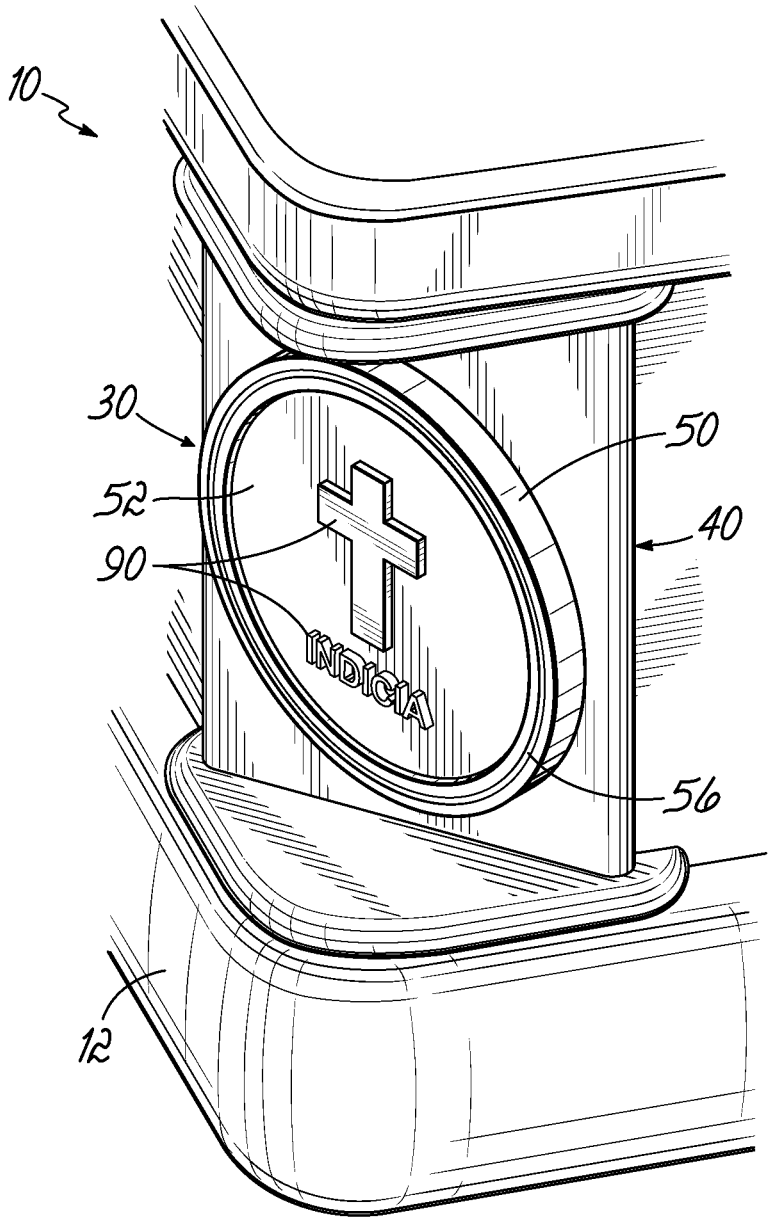
FIG. 3B is an assembled perspective view of the casket shell corner, universal medallion base, and die-struck medallion insert of FIG. 3A.
Figure 4:
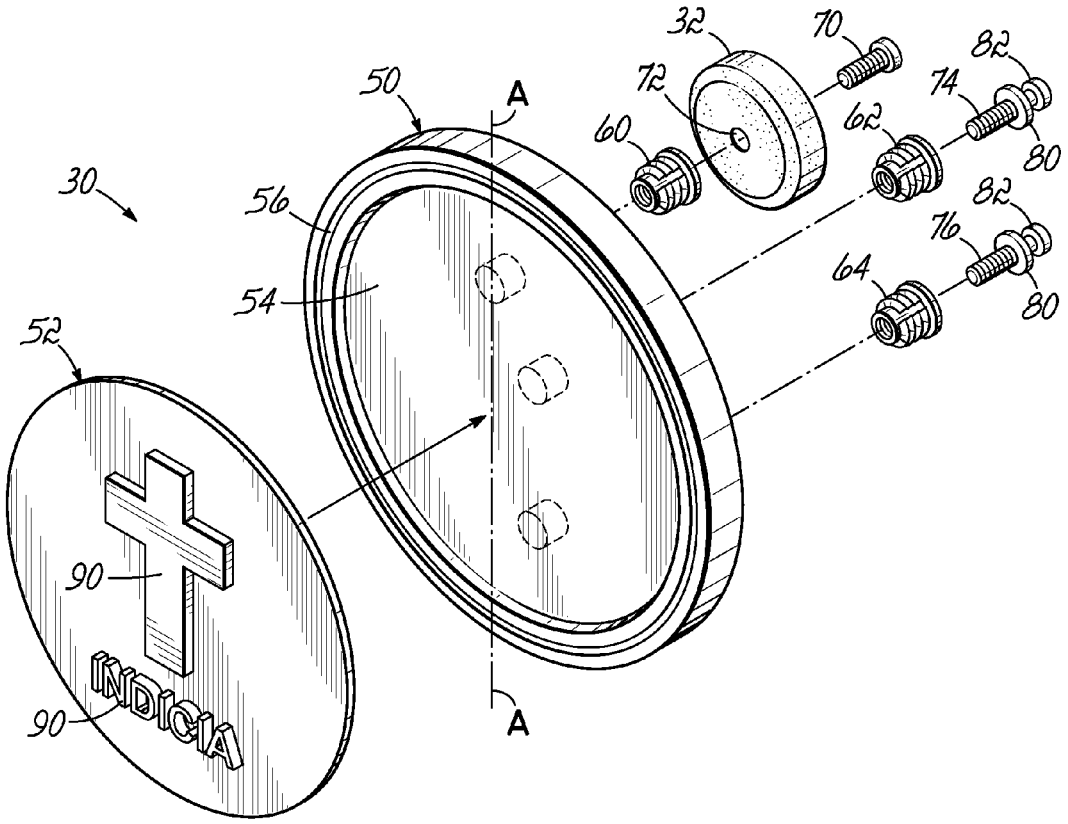
FIG. 4 is a disassembled front perspective view of the universal medallion base and die-struck medallion insert.
Figure 5:
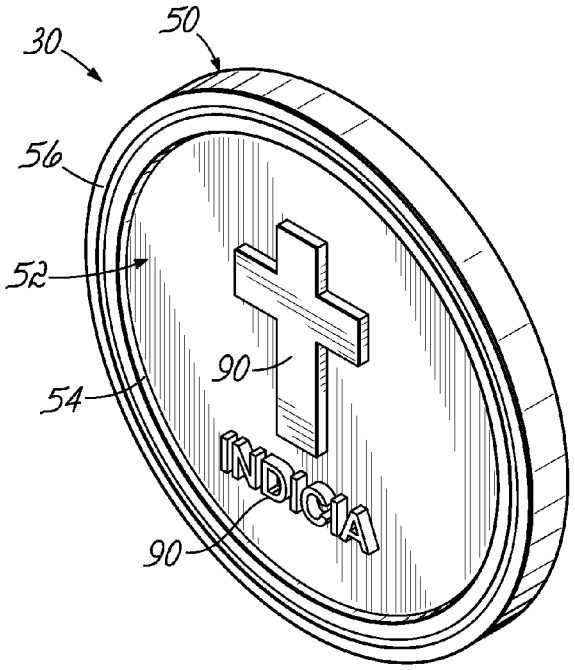
FIG. 5 is an assembled front perspective view of the universal medallion base and die-struck medallion insert of FIG. 4.
Figure 6:
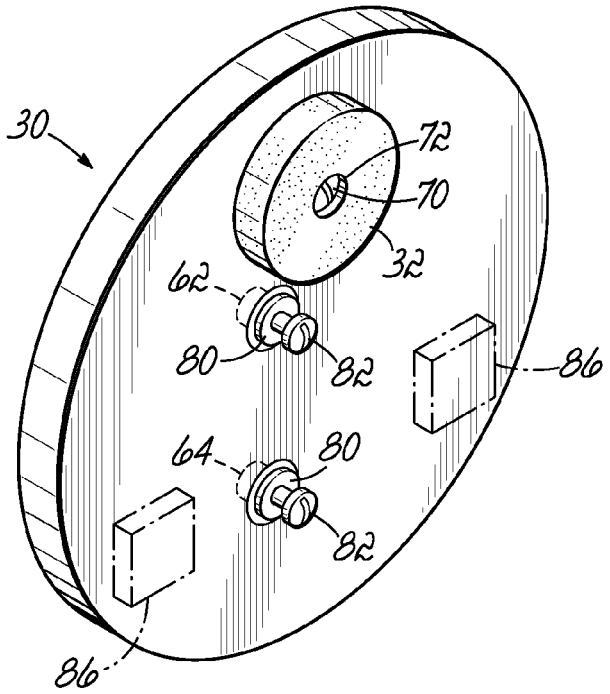
FIG. 6 is a rear perspective view of the universal medallion base.

Referring to FIGS. 3A and 3B, casket shell 12 includes a corner back plate 40 mounted with screws (not shown) generally at a 45 degree angle relative to adjacent ones of the side walls 14 and end walls 16 of the shell 12. A mounting plate 42 is mounted with screws (not shown) in a recess 44 in the back plate 40. Mounting plate 42 can be, but need not be, of two-piece construction, with a back portion (not shown) including a pair of vertically spaced spring clips (not shown), and a front portion including at least one, and preferably a pair of, vertically spaced, and preferably but not necessarily L-shaped, keyhole slots 46 which accept the heads of the shoulder screws 35 on medallion 30. Additional details of such a casket corner ornament attachment mechanism may be seen with reference to the assignee's U.S. Pat. Nos. 6,591,466, 6,928,706, and 7,340,810, and US Patent Application Publications Nos. 2010/0077579 and 2012/0266423, all hereby incorporated by reference herein as if fully set forth in their entirety. Back plate 40 can be provided with a relieved area 48 to accommodate magnet 32 during installation of medallion 30 on corner back plate 40.

Referring now to FIGS. 4-6 and 9, it will be seen that medallion type ornament 30 includes a universal ornament or medallion base 50 and an ornament or medallion insert 52 secured to the universal medallion base 50. Like the medallion of US Patent Application Publication No. 2010/0299895, universal medallion base 50 can be fabricated of metallic material, for example die cast pewter or aluminum, or non-metallic material, for example plastic, with a diameter of about 4.25 inches. Preferably, universal medallion base 50 is injection molded of plastic. Universal medallion base 50 has a recess 54 on a front side thereof for receiving the medallion insert 52. Preferably, the universal medallion base 50 and the recess 54 therein are circular, as is the medallion insert 52. The universal medallion base 50 can further include a one or more decorative circumferential grooves 56 positioned radially between a periphery of the recess 54 and a periphery of the universal medallion base 50.

The universal medallion base 50 preferably has three threaded inserts 60, 62, and 64 molded therein. Threaded insert 60 is positioned so as to position magnet 32 on an axis of symmetry A-A of universal medallion base 50 and near a perimeter of universal medallion base 50. Threaded inserts 62, 64 are horizontally offset from the axis of symmetry A-A of universal medallion base 50, are vertically aligned, and are positioned well within the perimeter of the universal ornament base 50. The horizontal offset corresponds to and is to compensate for the horizontal offset of the vertical terminal portions of keyhole slots 46, 46 in the corner back plate 40. A screw 70 passes through bore 72 in magnet 32 and threads into threaded insert 60 to secure magnet 32 onto the rear face of universal medallion base 50. Shoulder screws 74, 76, each having a shoulder 80 and a head 82, are threaded into threaded inserts 62, 64, respectively. A pair of felt or the like pads 86, 86 can be secured onto the rear face of the universal medallion base 50 to stabilize medallion base 50 when placed on magnetic cap panel 24 (FIG. 9) to prevent wobbling. When placing medallion base 50 on magnetic cap panel 24, medallion base 50 is oriented so as to position magnet 32 in the "12 o'clock" position to prevent swinging of the medallion base 50 on magnetic cap panel 24.

Medallion insert 52 is received into recess 54 of universal medallion blank 50 and is secured there with adhesives, double-sided adhesive tape, etc 57. Medallion insert 52 is preferably fabricated of brass or bronze and has text and/or graphics in the form of a three-dimensional image 90 die-struck into the medallion insert 52. The medallion insert 52 can have a diameter of about 3.75 inches and a thickness of about 0.030 inches, and the three-dimensional image 90 of the medallion insert 52 can have a height of about 0.065 inches. When installing medallion insert 52 into medallion base 50, care should be taken so as to orient the three-dimensional image 90 so that it is upright and aligned with the axis of symmetry A-A of medallion base 50.

In use, a funeral home will receive one or more shipments of caskets 10, universal ornament bases 50 and ornament inserts 52. During funeral planning, the family member/loved one will be offered a number of different ornament inserts 52 from which to choose. Once the family member/loved one has made their selection, the funeral director will ask the family member/loved one whether the ornament is to be mounted to the casket shell or to the casket lid. The funeral director will then secure the selected ornament insert 52 to the universal ornament base 50, and, depending on the answer received from the family member/love one, removably secure the ornament base 50 with ornament insert 52 secured thereto either to the casket shell 12 by inserting the heads 82 of shoulder screws 74, 76 into respective ones of the keyhole grooves 42, 42 in casket shell corner back plate 40 and seating the heads 82 in the grooves 42, 42, or to the casket lid 14 by positioning magnet 32 on the magnetic cap panel 24.

Ideally, a funeral home will receive caskets each of which has both the keyhole groove casket shell feature and the magnetic cap panel feature. However, it is possible for the funeral home to receive one group of caskets having just the keyhole groove casket shell feature, and another group of caskets having just the magnetic cap panel feature. In that case, the answer from the family member/loved one as to the location of mounting the ornament will dictate from which group of caskets the family member/loved will make their casket selection. The invention is also applicable to this scenario and consequently this scenario also falls within the scope of the invention.

Ideally, universal medallion bases 50 will be shipped to the funeral home with magnets 32 and shoulder screws 74, 76 preinstalled thereto. However, it is possible that the universal medallion bases 50 and hardware 32, 70, 74, 76 therefore could be shipped separately requiring assembly by the funeral director. In that case, once the family member/loved one has instructed the funeral director to mount the ornament to the casket shell or the casket lid, the funeral director need only install either both shoulder screws 74, 76 if the ornament is to be mounted to the casket shell, or the magnet 32 with screw 70 if the ornament is to be mounted to the casket lid. The invention is also applicable to this scenario and consequently this scenario also falls within the scope of the invention.

Alternatively still, the universal medallion bases 50 could be shipped to the funeral home with either just both shoulder screws 74, 76 installed, or with just the magnet 32 installed. In the former case, should the family member/loved one opt for casket shell mounting no manipulation of hardware is required. Also in the former case, should the family member/loved one opt for casket lid mounting the magnet 32 is installed; the shoulder screws 74, 76 can be removed or left installed. In the latter case, should the family member/loved one opt for casket shell mounting the shoulder screws 74, 76 are installed; the magnet 32 can be removed or left installed. In the latter case, should the family member/loved one opt for casket lid mounting no manipulation of hardware is required. The invention is also applicable to this scenario and consequently this scenario also falls within the scope of the invention.

Figure 7:
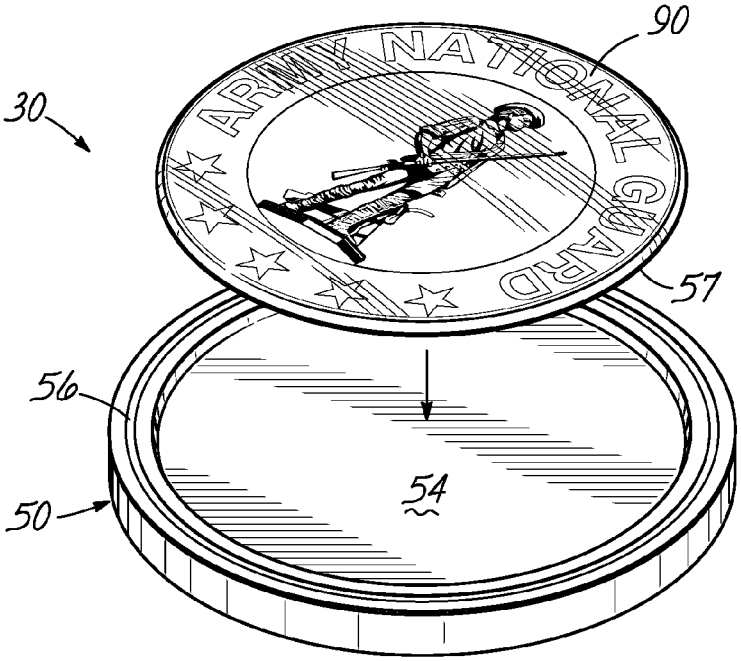
FIG. 7 is a disassembled perspective view of the universal medallion base and button medallion insert.

The invention herein is usable with button medallion inserts to produce a button medallion of the type disclosed in the assignee's US Patent Application Publication No. 2013/0074299, hereby incorporated by reference herein as if fully set forth in its entirety. See FIG. 7 wherein button medallion insert 90 is illustrated in use with universal medallion base 50.

Figure 8:
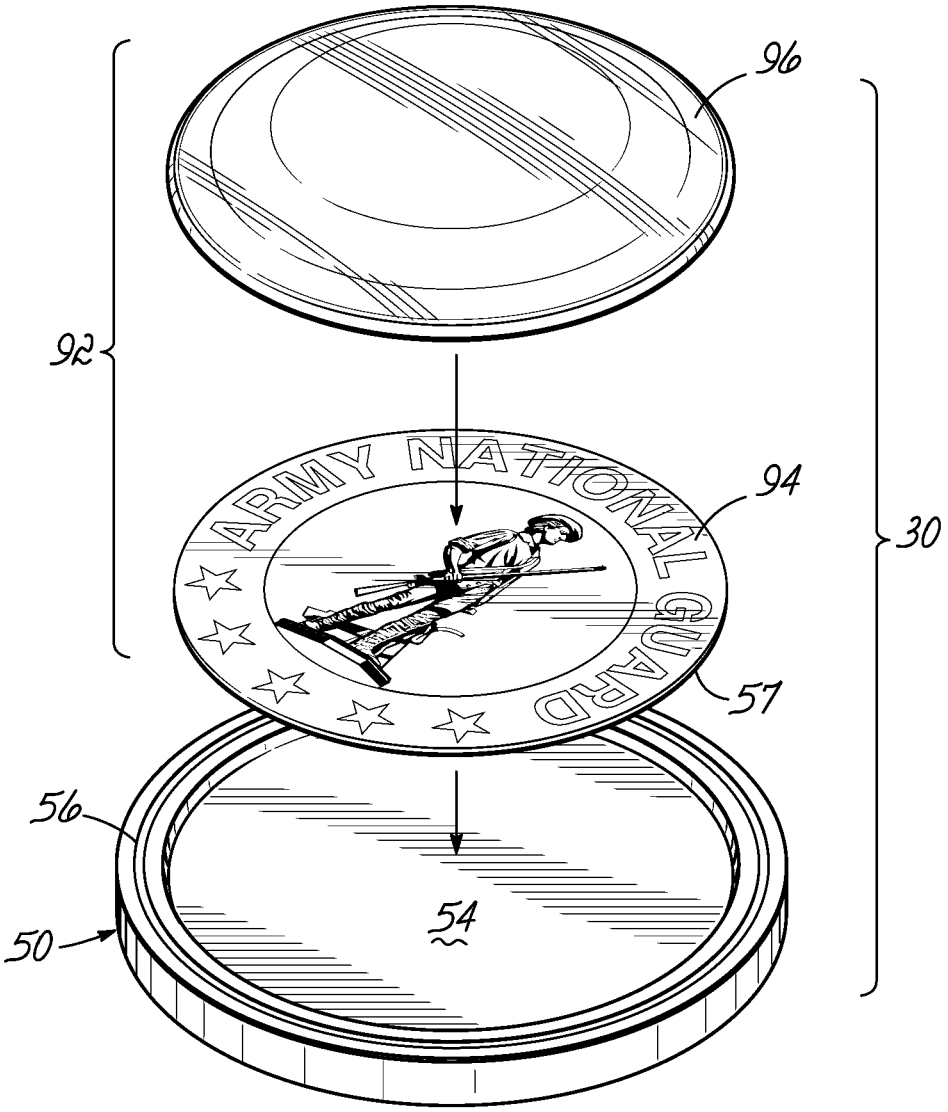
FIG. 8 is a disassembled perspective view of the universal medallion base and domed medallion insert.
Figure 9:
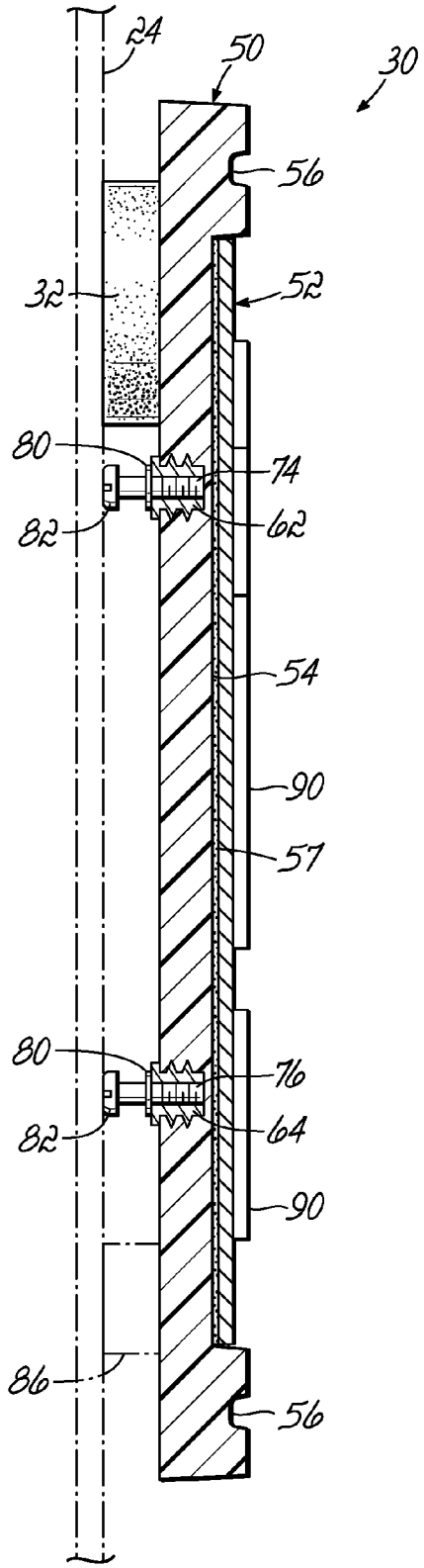
FIG. 9 is a cross-sectional view of the universal medallion base and die-struck medallion insert of FIGS. 4 and 5.

The invention herein is also usable with domed medallion inserts to produce a domed medallion of the type disclosed in the assignee's U.S. Provisional Patent Application No. 61/675,628 filed Jul. 25, 2012, hereby incorporated by reference herein as if fully set forth in its entirety. See FIG. 8 wherein domed medallion insert 92, having a substrate 94 with two-dimensional image thereon and a transparent domed overlayer 96, is illustrated in use with universal medallion base 50.

The invention herein is further usable with medallion inserts of other designs/constructions. For example, a porcelain medallion insert could be used with the universal medallion base 50 to produce a porcelain medallion.

The invention herein is therefore usable with a myriad of generally two-dimensional medallion style ornament inserts to produce a myriad of generally two-dimensional medallion style ornaments capable of being mounted to either the casket shell corner or the casket cap panel.

Figure 10:
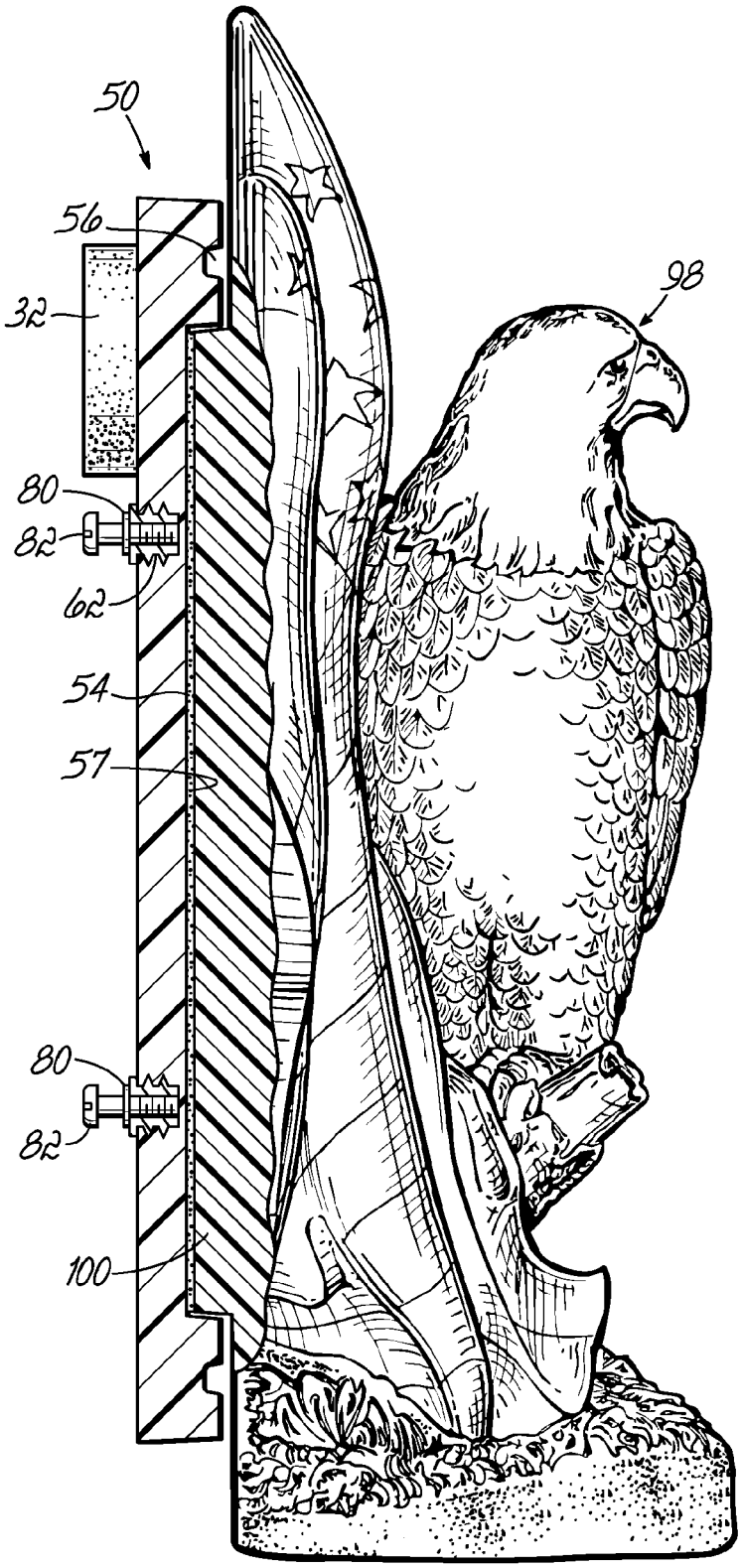
FIG. 10 is a cross-sectional view of the universal medallion base and three-dimensional figurine type ornament insert.

The invention herein is still further usable with a myriad of generally three-dimensional figurine style ornament inserts to produce a myriad of generally three-dimensional figurine style ornaments capable of being mounted to either the casket shell corner or the casket cap panel. See FIG. 10 wherein a generally three-dimensional figurine style ornament 98 is illustrated in use with universal ornament base 50. Generally three-dimensional figurine style ornament 98 is the subject of the assignee's U.S. Pat. No. Des. 418,961, hereby incorporated by reference herein as if fully set forth in its entirety. Note that rather than being circular to matingly fit into circular recess 54 in universal ornament base 50 like the prior embodiments of medallion inserts described above, figurine style ornament 98 is irregularly shaped and extends beyond the periphery of the recess 54 in universal ornament base 50. In order to mount figurine style ornament 98 to universal ornament base 50, figurine style ornament 98 can be molded with one or more raised surfaces or "stand offs" 100 extending rearwardly from a rear face thereof of a height approximately equal to the depth of the recess 54, and that fit within the perimeter of the circular recess 54, thereby providing a surface to adhere with the adhesive 57 to recess 54.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A casket comprising:

a casket shell including at least one keyhole groove in an exterior surface thereof, a casket lid closeable on said shell, said lid including a magnetic cap panel mounted therein, a universal ornament base having a front side and a rear side, said rear side including at least one magnet mounted thereon and at least one fastener secured thereto, said fastener having a head thereon, and a physically separate ornament insert secured to said front side of said ornament base, said ornament base and ornament insert removably secured to one of said shell and said lid, by inserting said head of said fastener in said keyhole groove of said shell and seating said head of said fastener in said keyhole groove, and by positioning said magnet on said magnetic cap panel, respectively.

2. The casket of claim 1 wherein said ornament insert is a generally three-dimensional figurine ornament.

3. The casket of claim 1 wherein said ornament insert is a generally two-dimensional medallion ornament.

4. The casket of claim 1 wherein said ornament base is fabricated of die cast aluminum.

5. A casket comprising:

a casket shell including at least one keyhole groove in an exterior surface thereof, a casket lid closeable on said shell, said lid including a magnetic cap panel mounted therein, a universal ornament base having a front side and a rear side, said rear side including at least one magnet mounted thereon and at least one fastener secured thereto, said fastener having a head thereon, and an ornament insert secured to said front side of said ornament base, said ornament base and ornament insert removably secured to one of said shell and said lid, by inserting said head of said fastener in said keyhole groove of said shell and seating said head of said fastener in said keyhole groove, and by positioning said magnet on said magnetic cap panel, respectively, wherein said magnet is positioned on an axis of symmetry of said ornament base and said fastener is positioned offset from the axis of symmetry of said ornament base.

6. The casket of claim 5 wherein said at least one magnet comprises a single magnet positioned near a perimeter of said ornament base, and said at least one fastener comprises a pair of vertically spaced fasteners positioned well within the perimeter of said ornament base.

7. The casket of claim 6 wherein said ornament insert is a generally two-dimensional medallion ornament.

8. The casket of claim 5 wherein said ornament base is a circular medallion blank having a circular recess therein and a circumferential groove between a periphery of said recess and a periphery of said medallion blank.

9. The casket of claim 5 wherein said ornament base is fabricated of plastic and said plastic ornament base is molded with three threaded inserts molded therein, said at least one fastener comprises two shoulder screws received in two of said threaded inserts, and a screw is received in the third said threaded insert securing said at least one magnet to said ornament base.

10. A universal casket ornament base for removably securing a physically separate ornament insert to a keyhole groove in an exterior of a casket shell or to a magnetic cap panel mounted in a casket lid, as desired, said casket ornament base comprising:

an ornament base body having a front side and a rear side, said rear side of said ornament base body including at least one magnet mounted thereon and at least one fastener secured thereto, said fastener having a head thereon, said front side of said ornament base body configured to have the physically separate ornament insert secured thereto, in that said front side of said ornament base has a cylindrical recess therein adapted to receive one of a generally two-dimensional medallion ornament insert and a generally three-dimensional figurine ornament insert, whereby said ornament base and the ornament insert can be removably secured to the shell by inserting said head of said fastener in the keyhole groove of the shell and seating said head of said fastener in the keyhole groove, or said ornament base and the ornament insert can be removably secured to the lid by positioning said magnet on the magnetic cap panel, as desired.

11. The casket ornament base of claim 10 wherein said ornament base body is fabricated of die cast aluminum.

12. A universal casket ornament base for removably securing an ornament insert to a keyhole groove in an exterior of a casket shell or to a magnetic cap panel mounted in a casket lid, as desired, said ornament base comprising:

an ornament base body having a front side and a rear side, said rear side of said ornament base body including at least one magnet mounted thereon and at least one fastener secured thereto, said fastener having a head thereon, said front side of said ornament base body configured to have the ornament insert secured thereto, whereby said ornament base and the ornament insert can be removably secured to the shell by inserting said head of said fastener in the keyhole groove of the shell and seating said head of said fastener in the keyhole groove, or said ornament base and the ornament insert can be removably secured to the lid by positioning said magnet on the magnetic cap panel, as desired, wherein said magnet is positioned on an axis of symmetry of said ornament base body and said fastener is positioned offset from the axis of symmetry of said ornament base body.

13. The casket ornament base of claim 12 wherein said at least one magnet comprises a single magnet positioned near a perimeter of said ornament base body, and said at least one fastener comprises a pair of vertically spaced fasteners positioned well within the perimeter of said ornament base body.

14. The casket ornament base of claim 13 wherein said ornament base body is configured to have a generally two-dimensional medallion ornament insert secured thereto.

15. The casket ornament base of claim 12 wherein said ornament base body is a circular medallion blank having a circular recess therein and a circumferential groove between a periphery of said recess and a periphery of said medallion blank.

16. The casket ornament base of claim 12 wherein said ornament base body is fabricated of plastic and said plastic ornament base body is molded with three threaded inserts molded therein, said at least one fastener comprises two shoulder screws received in two of said threaded inserts, and a screw is received in the third said threaded insert securing said at least one magnet to said ornament base body.

17. A method of personalizing a casket according to a family member's wishes, the casket having a keyhole groove in an exterior of a shell of the casket and a magnetic cap panel mounted in a lid of the casket, the method comprising:

receiving the casket, receiving a universal ornament base, receiving a physically separate ornament insert, the universal ornament base configured to have the ornament insert secured on one side thereof, and configured to have a fastener with a head thereon and a magnet secured on the other side thereof, receiving the fastener, receiving the magnet, querying the family member as to whether the ornament insert and ornament base are to be mounted to the casket shell or to the casket lid, securing the ornament insert to the ornament base, and in response to the answer received from the family member to the query, removably securing the ornament insert and ornament base either to the casket shell by inserting the head of the fastener in the keyhole groove of the shell and seating the head of the fastener in the keyhole groove, or to the casket lid by positioning the magnet on the magnetic cap panel.

18. The method of claim 17 further comprising the step of:

prior to the step of removably securing the ornament insert and ornament base either to the casket shell or to the casket lid, securing either the fastener or the magnet to the ornament base in response to the answer received from the family member to the query.

19. The method of claim 17 wherein the steps of receiving the ornament base, receiving the fastener, and receiving the magnet comprise receiving the ornament base with the fastener and the magnet preinstalled thereto.

20. A method of personalizing a casket according to a family member's wishes, the casket having a keyhole groove in an exterior of a shell of the casket and a magnetic cap panel mounted in a lid of the casket, the method comprising:

receiving the casket, receiving an ornament insert, receiving a universal ornament base configured to have the ornament insert secured on one side thereof, and configured to have a fastener with a head thereon and a magnet secured on the other side thereof, receiving the fastener, receiving the magnet, querying the family member as to whether the ornament insert and ornament base are to be mounted to the casket shell or to the casket lid, securing the ornament insert to the ornament base, and in response to the answer received from the family member to the query, removably securing the ornament insert and ornament base either to the casket shell by inserting the head of the fastener in the keyhole groove of the shell and seating the head of the fastener in the keyhole groove, or to the casket lid by positioning the magnet on the magnetic cap panel, wherein the universal ornament base is a universal medallion blank and the ornament insert is a medallion insert.

21. The method of claim 20 wherein the medallion insert is a metallic die-struck medallion insert.

22. The method of claim 20 wherein the medallion insert is a button medallion insert.

23. The method of claim 20 wherein the medallion insert is a domed medallion insert.

24. A method of personalizing a casket according to a family member's wishes, the method comprising:

receiving a universal ornament base, receiving a plurality of physically separate ornament inserts, the universal ornament base configured to have a selected ornament insert of the plurality of ornament inserts secured on one side thereof, and configured to have a fastener with a head thereon and a magnet secured on the other side thereof, receiving the fastener, receiving the magnet, presenting the plurality of ornament inserts to the family member, allowing the family member to select an ornament insert from the plurality of ornament inserts, querying the family member as to whether the selected ornament insert and ornament base are to be mounted to a casket shell or to a casket lid, securing the selected ornament insert to the ornament base, and in response to the answer received from the family member to the query, removably securing the selected ornament insert and ornament base either to the casket shell by inserting the head of the fastener in a keyhole groove in an exterior of the casket shell and seating the head of the fastener in the keyhole groove, or to the casket lid by positioning the magnet on a magnetic cap panel mounted in the casket lid.

25. A method of personalizing a casket according to a family member's wishes, the method comprising:

receiving a plurality of ornament inserts, receiving a universal ornament base configured to have a selected ornament insert of the plurality of ornament inserts secured on one side thereof, and configured to have a fastener with a head thereon and a magnet secured on the other side thereof, receiving the fastener, receiving the magnet, presenting the plurality of ornament inserts to the family member, allowing the family member to select an ornament insert from the plurality of ornament inserts, querying the family member as to whether the selected ornament insert and ornament base are to be mounted to a casket shell or to a casket lid, securing the selected ornament insert to the ornament base, and in response to the answer received from the family member to the query, removably securing the selected ornament insert and ornament base either to the casket shell by inserting the head of the fastener in a keyhole groove in an exterior of the casket shell and seating the head of the fastener in the keyhole groove, or to the casket lid by positioning the magnet on a magnetic cap panel mounted in the casket lid, wherein the universal ornament base is a medallion blank, and the ornament insert is selected from the group consisting of a medallion insert and a figurine insert.

* * * * *